US005998775A

United States Patent [19]

Sung

[11] Patent Number: 5,998,775

[45] Date of Patent: Dec. 7, 1999

[54] MICROWAVE OVEN HAVING A COOKING CHAMBER REFLECTING MICROWAVES AT VARYING ANGLES

[75] Inventor: Han-Jun Sung, Suwon, Rep. of Korea

[73] Assignee: Samsung Electronics Co., Ltd., Suwon-City, Rep. of Korea

[21] Appl. No.: 09/066,549

[22] Filed: Apr. 27, 1998

[30] Foreign Application Priority Data

| | | | |
|---|---|---|---|
| Aug. 26, 1997 | [KR] | Rep. of Korea | 97-41061 |
| Aug. 26, 1997 | [KR] | Rep. of Korea | 97-41062 |
| Aug. 26, 1997 | [KR] | Rep. of Korea | 97-41063 |

[51] Int. Cl.[6] ..... H05B 9/06

[52] U.S. Cl. ..... 219/751; 219/709

[58] Field of Search ..... 219/728, 745, 219/750, 751, 709

[56] References Cited

U.S. PATENT DOCUMENTS

| | | | |
|---|---|---|---|
| 3,526,737 | 9/1970 | Black | 219/751 |

FOREIGN PATENT DOCUMENTS

| | | |
|---|---|---|
| 0 457 948 | 11/1991 | European Pat. Off. . |
| 050 13162 | 1/1993 | Japan . |
| 062 23962 | 8/1994 | Japan . |
| 2 139 009 | 10/1984 | United Kingdom . |

*Primary Examiner*—Tu Ba Hoang

*Attorney, Agent, or Firm*—Burns, Doane, Swecker & Mathis, L.L.P.

[57] ABSTRACT

A microwave oven includes a main body, a cooking chamber provided in the main body, and an electrical component compartment containing electrical components, including a magnetron for supplying microwaves to the cooking chamber. Disposed in the cooking chamber is a microwave reflecting varying plate continuously reciprocated by a drive motor during a cooking operation, for reflecting microwaves at continuously varying angles.

8 Claims, 8 Drawing Sheets

FIG. 8
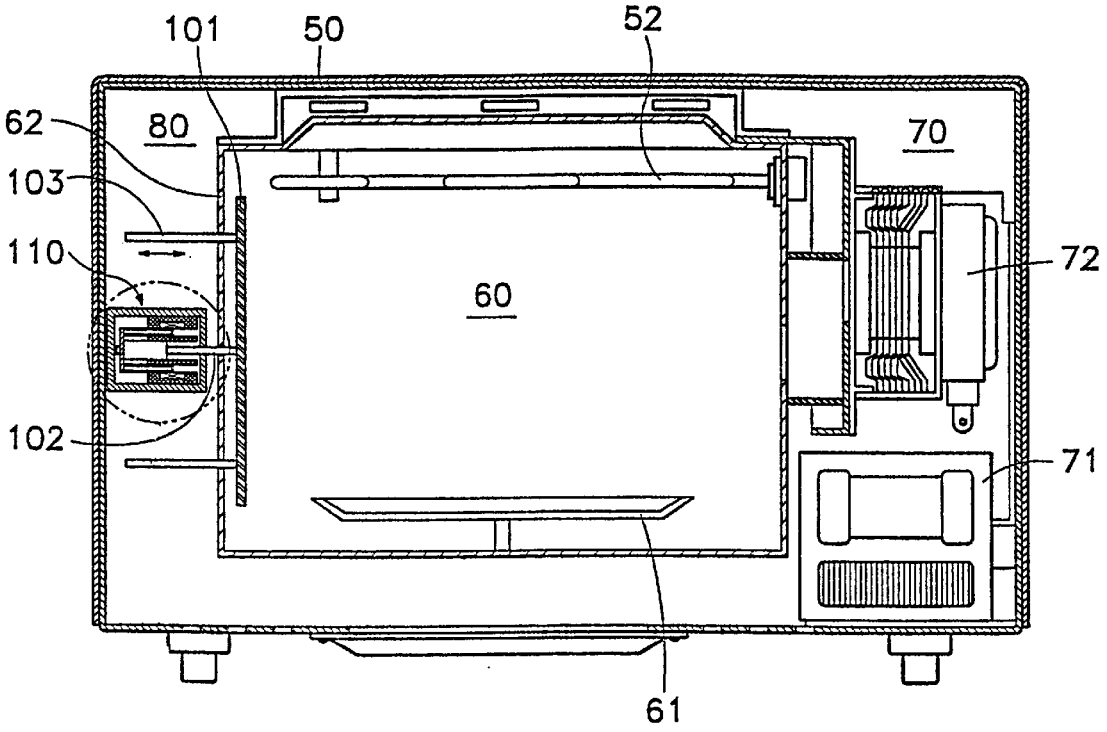
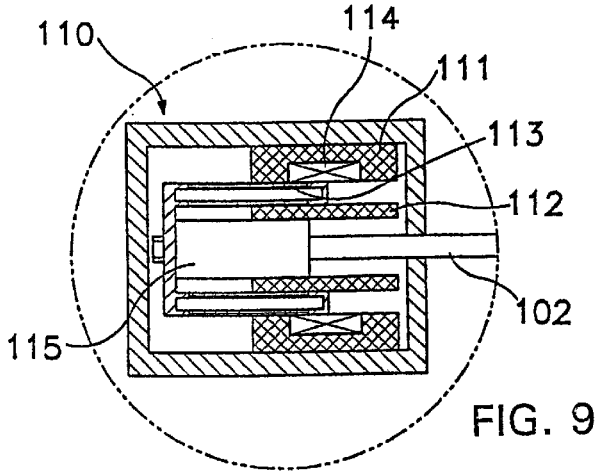
FIG. 9

MICROWAVE OVEN HAVING A COOKING CHAMBER REFLECTING MICROWAVES AT VARYING ANGLES

BACKGROUND OF THE INVENTION (1) Field of the Invention

The present invention relates to a microwave oven, and more particularly, to a microwave oven which reflects microwaves off inside walls of a cooking chamber.

(2) Description of the Prior Art

Generally, a microwave oven is a cooking appliance which cooks food by frictional heat generated by making the molecules of the food being cooked move at high speeds with the use of microwaves.

Referring to FIGS. 1 and 2, shown respectively are an exploded perspective view of a conventional microwave oven and a front sectional view of the microwave oven illustrated in FIG. 1.

As shown in drawings, the conventional microwave oven comprises a main body 10 defining an exterior of the microwave oven, a cooking chamber 20 having predetermined dimensions and inside of which food to be cooked is placed, and an electrical component compartment 30 provided to one side of the cooking chamber 20. Provided on a front of the microwave oven are a door 40 for opening and closing the cooking chamber 20, the door 40 being attached by hinge members (not shown), and a control panel 41 which is manipulated by the user to make various selections for the cooking and heating of food.

Mounted inside the electrical component compartment 30 are a transformer 31 for raising a level of voltage supplied from an external electric power source, a magnetron 32 for generating microwaves using the high voltage supplied from the transformer 31 and radiating the microwaves into the cooking chamber 20, a fan 34 for cooling the various electrical components in the electrical component compartment 30 by drawing external air therein, and a guide duct 33 for directing the external air drawn into the electrical component compartment 30 by the fan 34 to the cooking chamber 20.

Provided inside the cooking chamber 20 are a cooking tray 21 disposed on a bottom surface of the same, and a heater 12 for grilling food, the heater 12 being mounted on an upper portion of the cooking chamber 20.

In the prior art microwave oven structured as described above, the cooking and heating of food is realized by the radiation of microwaves into the cooking chamber by the magnetron, after which the microwaves are reflected off inside surfaces of walls of the cooking chamber to the food therein.

However, as the microwaves are reflected off the inside surfaces of the walls in continuously identical angles and patterns throughout the cooking process, different surface areas of the food inside the cooking chamber receive different amounts of microwaves. As a result, the food is heated or cooked unevenly.

SUMMARY OF THE INVENTION

The present invention has been made in an effort to solve the above described problems.

It is an object of the present invention to provide a microwave oven with a cooking chamber in which microwaves are reflected at varying angles to evenly cook or heat food therein.

To achieve the above object, the present invention provides a microwave oven having a main body, a cooking chamber provided in the main body, and an electrical component compartment containing electrical components including a magnetron for supplying microwaves to the cooking chamber. The microwave oven further includes a microwave reflecting varying device for reflecting microwaves present in the cooking chamber at varying angles during a cooking operation.

Preferably, the varying device includes an angle-varying element disposed in the cooking chamber and movable to different microwave-reflecting positions in the cooking chamber. A drive element is provided for moving the angle-varying element between the different reflecting positions to reflect the microwaves at different angles. Preferably, the drive element continuously moves the angle-varying element between the different positions during a cooking operation. The angle-varying element preferably comprises a plate arranged parallel and adjacent to a wall of the cooking chamber for rectilinear movement toward and away from the wall.

The microwave reflecting varying device preferably comprises drive means for operating the microwave reflection varying device, varying means for undergoing rectilinear movement on one side of the cooking chamber by operation of the drive means to reflect microwaves to varying angles, and drive power transmitting means for transmitting drive power supplied by the drive means to the varying means.

According to one aspect, the drive means is a DC motor mounted to an inside surface of a wall of the main body; and the varying means comprises a movable plate disposed in the cooking chamber and which undergoes rectilinear movement therein, a support plate disposed outside the cooking chamber and connected to the drive power transmitting means to receive drive power of the DC motor, and a plurality of connecting rods passing through a side wall of the cooking chamber to interconnect the movable plate and the support plate. The drive power transmitting means preferably comprises a cylindrical rotating wheel connected to the DC motor and having a drive protrusion integrally formed on one side, a driven shaft one end of which is fixed to an upper portion of the support plate and another end of which carries a driven protrusion, a power transmitting shaft connecting the rotating wheel and the driven shaft to convert rotational movement of the DC motor into rectilinear movement of the driven shaft, and a fixed shaft one end of which is fixedly mounted to the side wall of the cooking chamber and another end of which is connected to a center portion of the power transmitting shaft.

The power transmitting shaft preferably has a first slot into which the drive protrusion of the rotating wheel is inserted, and a second slot into which the driven protrusion of the driven shaft is inserted.

Alternatively, the drive means is a DC motor mounted to an inside surface of a wall of the main body; and the varying means comprises a movable plate provided inside the cooking chamber and which undergoes rectilinear movement by drive power of the DC motor transmitted from the drive power transmitting means, and a plurality of guide rods connected to upper and lower portions of the movable plate and passing through a side wall of the cooking chamber to support the movable plate and guide a rectilinear movement of the same. The drive power transmitting means preferably comprises a cylindrical cam connected to the DC motor, a distal face of which is obliquely slanted, a driven shaft, one end of which passes through the side wall of the cooking chamber to be connected to a center portion of the movable plate, and a plurality of springs mounted to each guide rod of the varying means and the inside surface of the wall of the main body, the springs providing a pulling force to pull the variable plate in a direction toward the side wall of the cooking chamber. A groove is preferably formed around a circumference of the slanted face of the cam and the driven shaft is mounted in the groove.

Alternatively, the drive means is a linear motor disposed on an inside surface of a wall of the main body; and the varying means comprises a movable plate provided inside the cooking chamber and which undergoes rectilinear movement therein by drive power of the linear motor transmitted from the drive power transmitting means, and a plurality of guide rods connected to upper and lower portions of the movable plate and passing through a side wall of the cooking chamber to support the movable plate and guide a rectilinear movement of the same. The linear motor is preferably comprised of a first stator, a second stator, a permanent magnet interposed between the first and second stators, and a coil. The drive power transmitting means preferably comprises a drive element disposed in a center portion of the linear motor and which undergoes rectilinear movement by an electromagnetic force of the linear motor, and a driven shaft one end of which is connected to the drive element and another end of which is connected to a center portion of the movable plate after passing through the side wall of the cooking chamber.

BRIEF DESCRIPTION OF THE DRAWING

The above object, and other features and advantages of the present invention will become more apparent by describing preferred embodiments thereof in detail with reference to the attached drawings, in which:

FIG. 8 is a front sectional view of a microwave oven according to a third preferred embodiment of the present invention; and FIG. 9 is an enlarged view of a linear motor encircled in FIG. 8.

DETAILED DESCRIPTION OF PREFERRED EMBODIMENTS OF THE INVENTION

Preferred embodiments of the present invention will now be described in detail with reference to the accompanying drawings.

Figure 1:
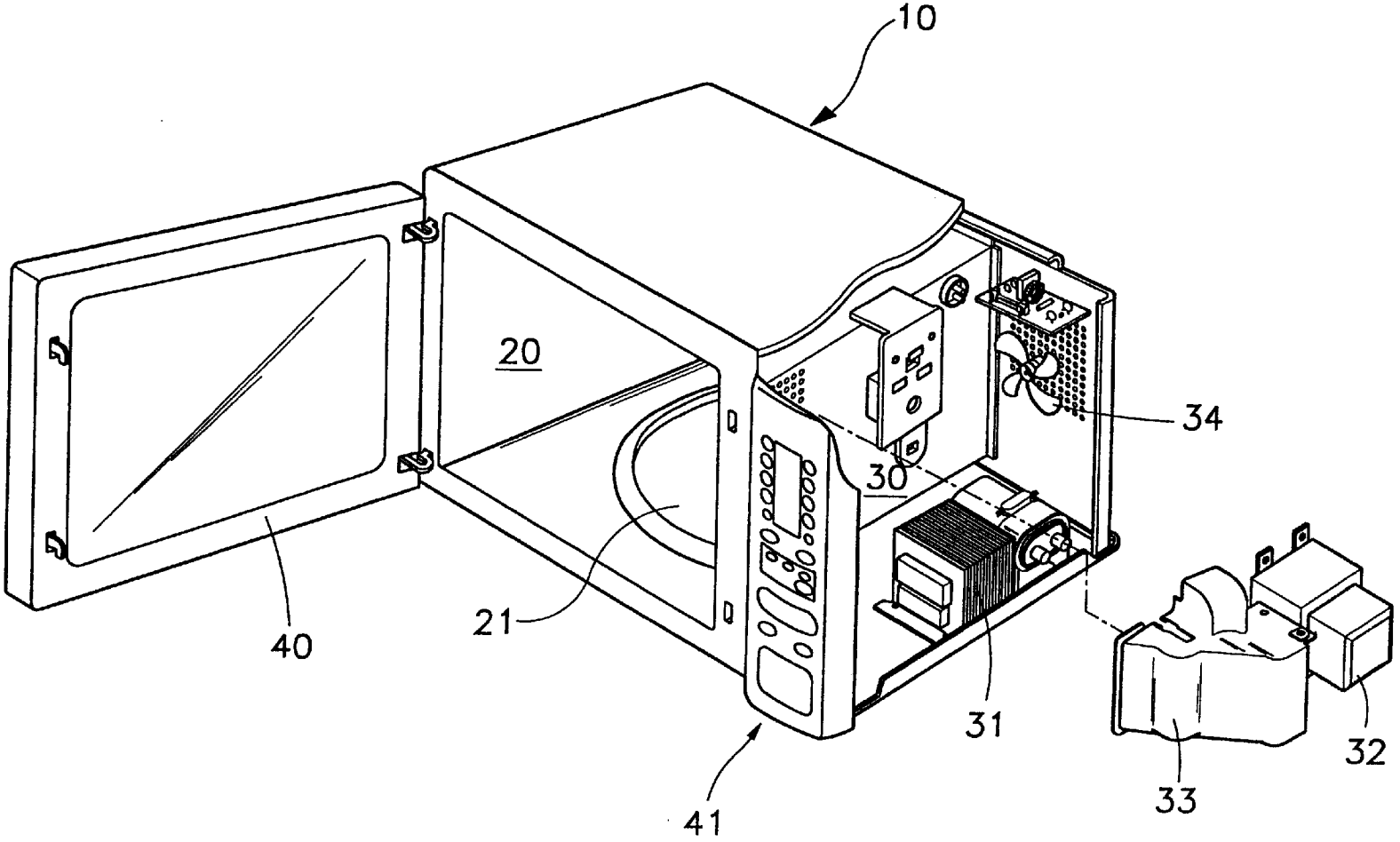
FIG. 1 (PRIOR ART)
FIG. 1 is an exploded perspective view of a conventional microwave oven.
Figure 2:
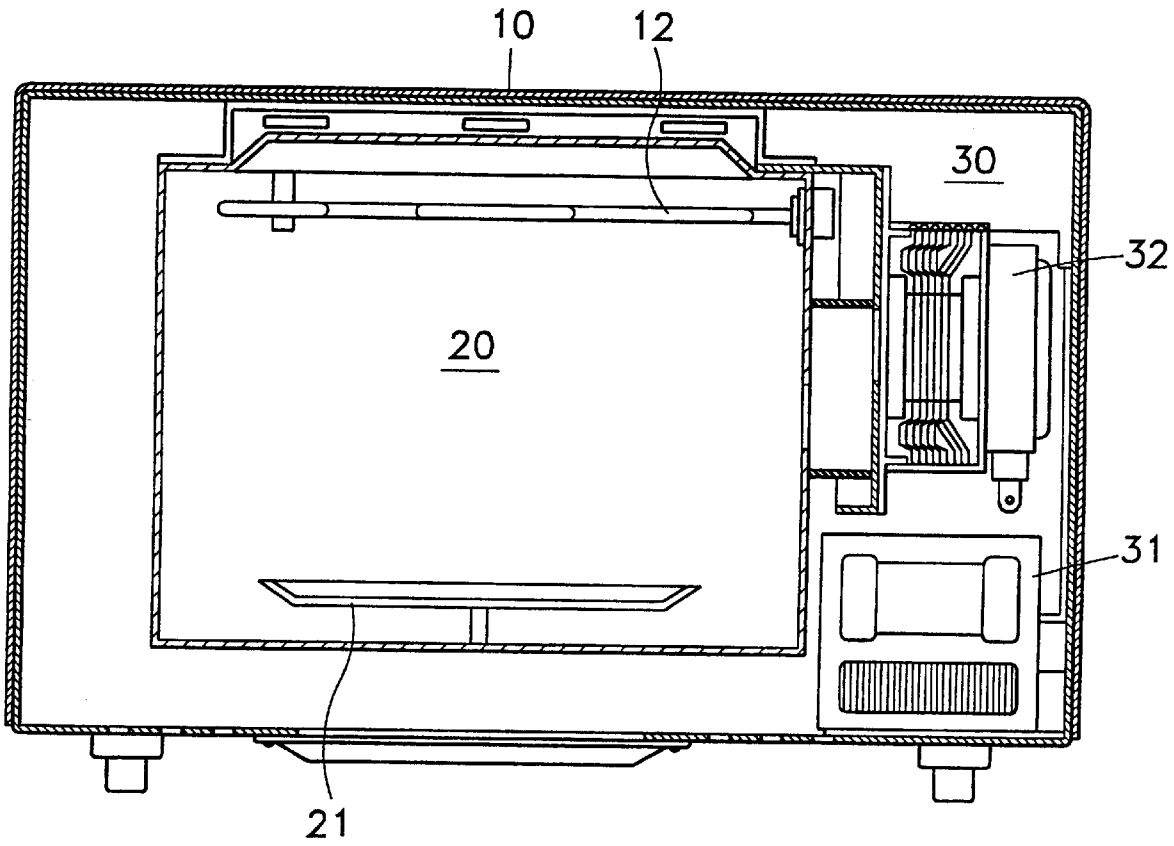
FIG. 2 (PRIOR ART)
FIG. 2 is a front sectional view of the microwave oven shown in FIG. 1.
Figure 3:
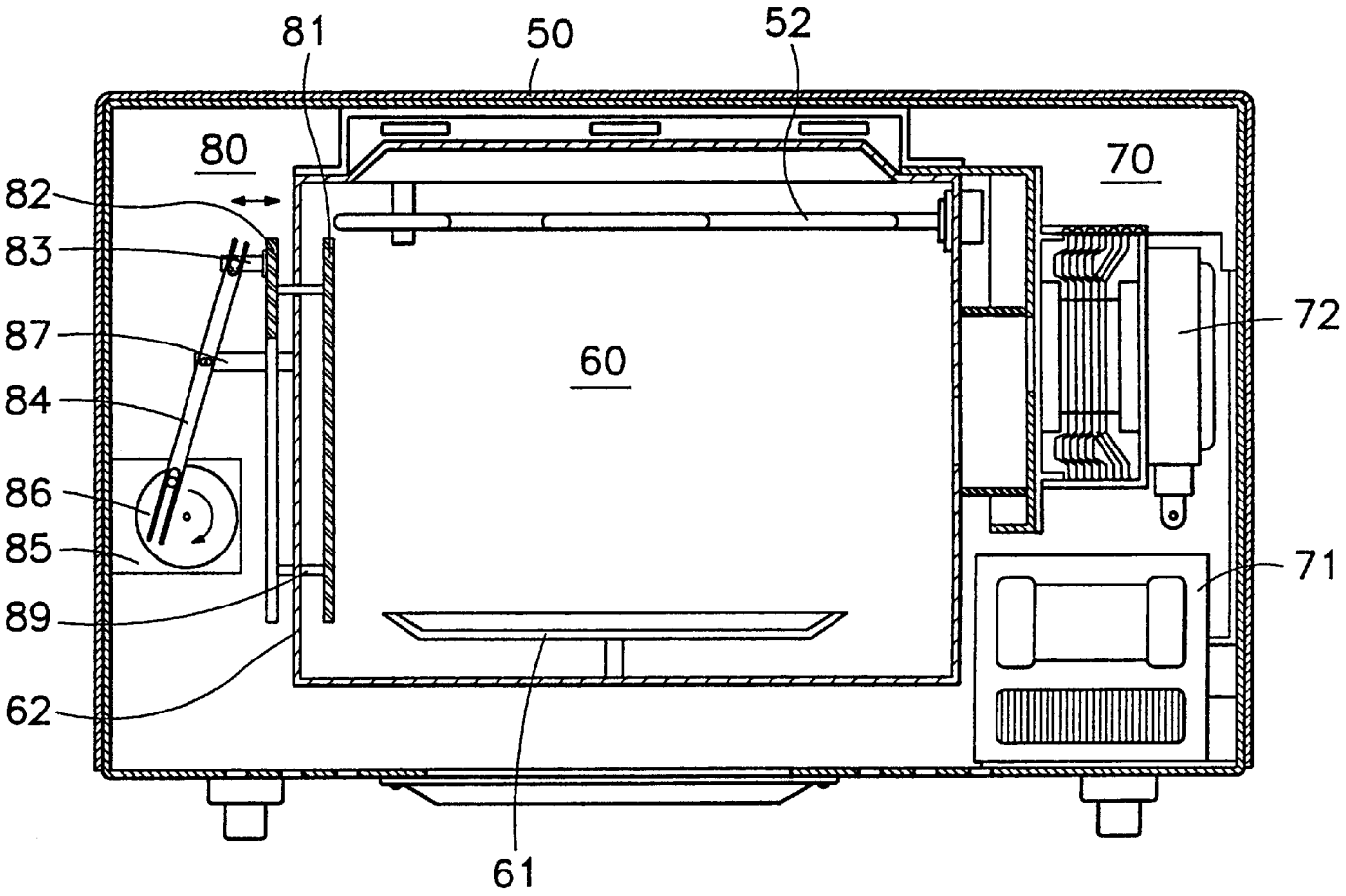
FIG. 3 is a front sectional view of a microwave oven according to a first preferred embodiment of the present invention.
Figure 4:
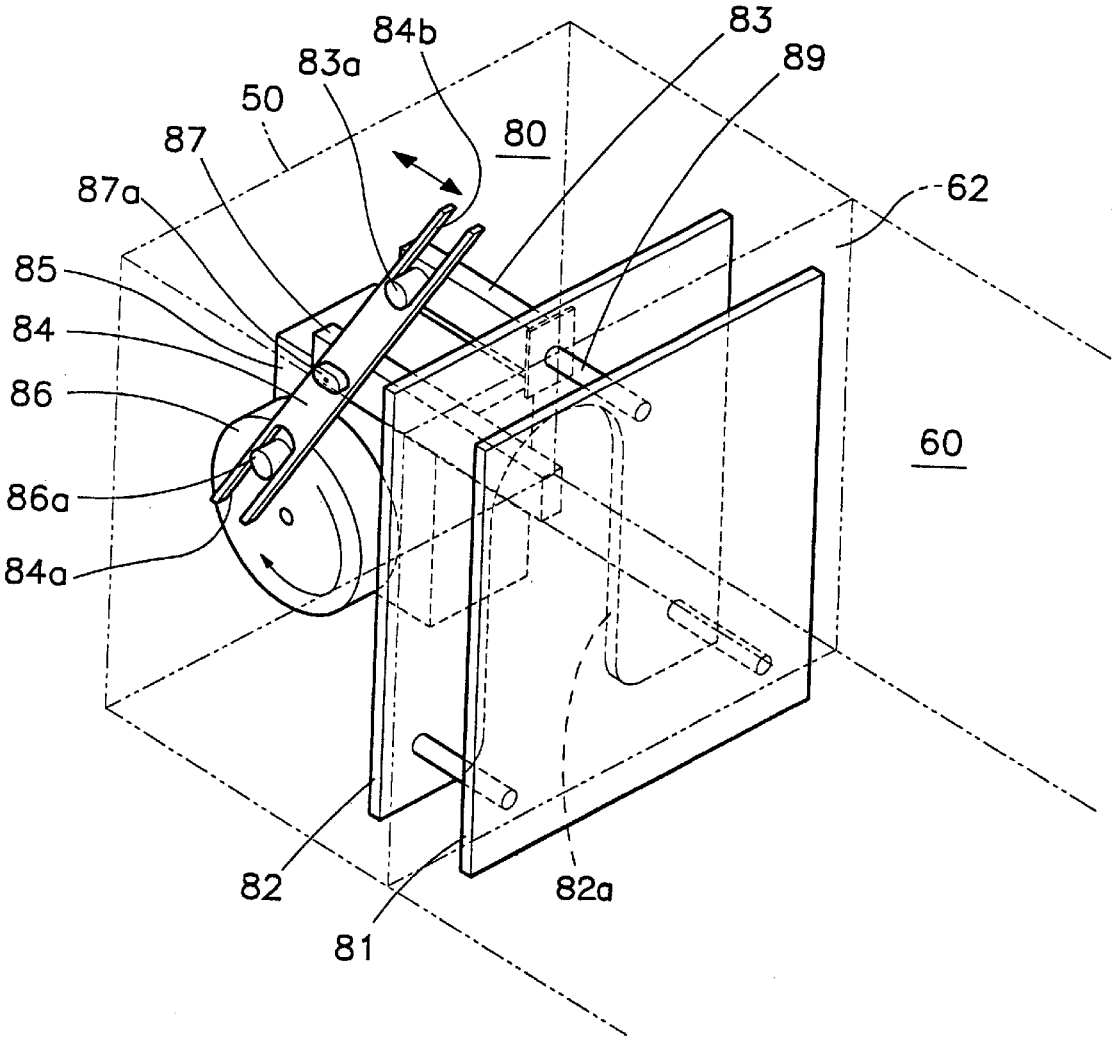
FIG. 4 is a perspective view of a microwave reflection varying device shown in FIG. 3.
Figure 5:
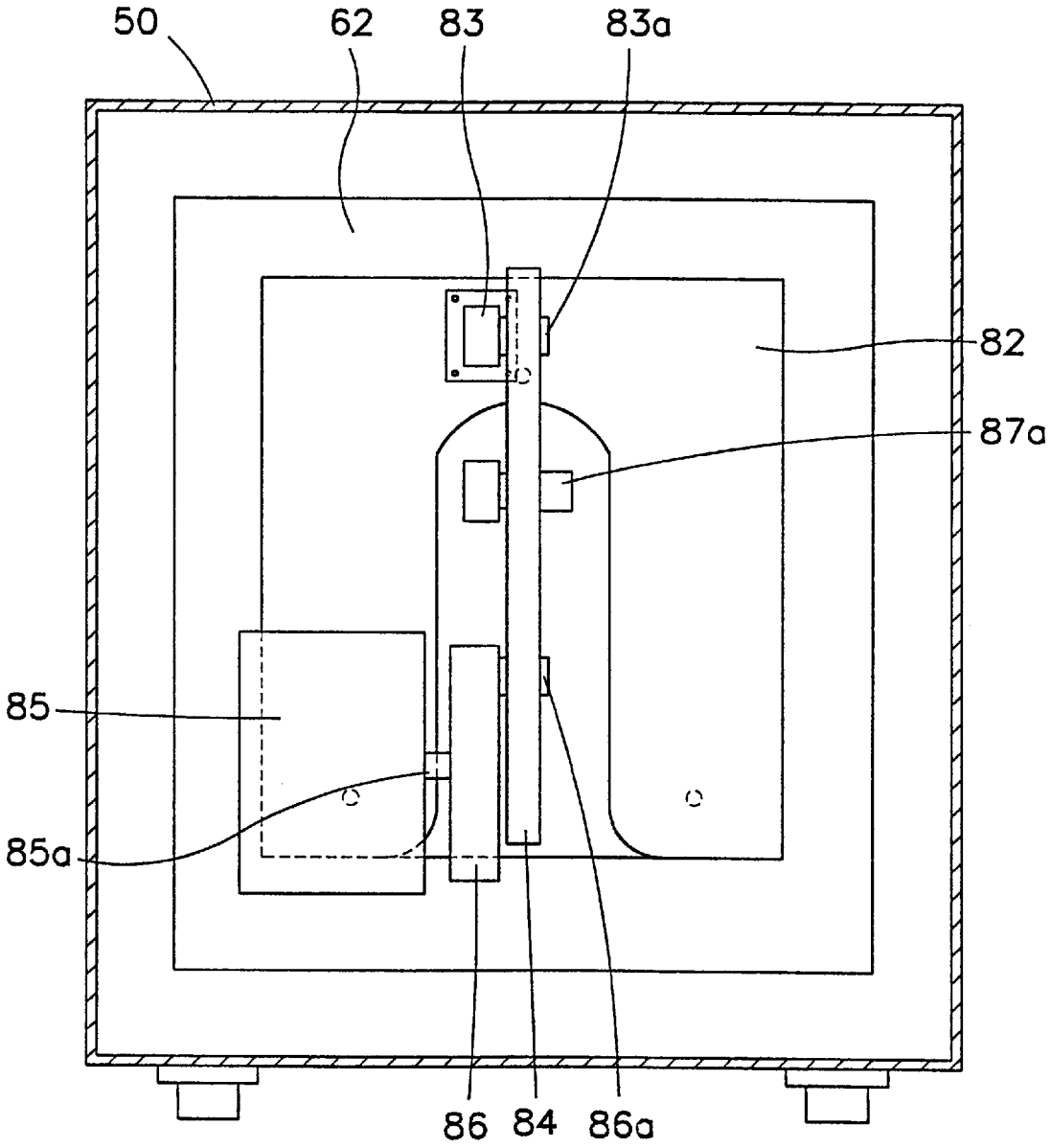
FIG. 5 is a side view of the microwave reflection varying device shown in FIG. 3.

Referring to FIGS. 3, 4, and 5, shown respectively are a front sectional view of a microwave oven according to a first preferred embodiment of the present invention, a perspective view of a microwave reflection varying device shown in FIG. 3, and a side view of the microwave reflection varying device shown in FIG. 3.

As shown in drawing FIGS. 3–5, a first embodiment of a microwave oven comprises a main body 50 defining an exterior of the microwave oven, a cooking chamber 60 having predetermined dimensions and inside of which food to be cooked is placed, and an electrical component compartment 70 provided to one side of the cooking chamber 60.

Mounted inside the electrical component compartment 70 are a transformer 71 for raising a level of voltage supplied from an external electric power source, and a magnetron 72 for generating microwaves using the high voltage supplied from the transformer 71 and radiating the microwaves to the cooking chamber 60.

Provided inside the cooking chamber 60 are a cooking tray 61 disposed on a bottom surface of the same, and a heater 52 for grilling food, the heater 52 being mounted on an upper portion of the cooking chamber 60.

The inventive microwave oven further comprises a microwave reflection varying device disposed partly in a cavity 80 and partly in the cooking chamber 60, the cavity 80 being provided between the main body 50 and a side wall 62 of the cooking chamber 60 on a side of the same opposite that of the electrical component compartment 70. The microwave reflection varying device includes drive means, angle-varying means for undergoing rectilinear movement at one side of the cooking chamber 60 by operation of the drive means, and drive power transmitting means for transmitting drive power from the drive means to the angle-varying means.

The drive means comprises a DC motor 85 disposed in the cavity 80 and mounted to an inside surface of a wall of the main body 50.

The angle-varying means comprises an element in the form of a quadrilateral plate 81 provided inside the cooking chamber 60 and which undergoes rectilinear movement in directions toward and away from the electrical component compartment 70, a support plate 82 disposed inside the cavity 80 on a side of the side wall 62 opposite that of the movable plate 81 and connected to the drive power transmitting means, and a plurality of connecting rods 89 penetrating the side wall 62 of the cooking chamber 60 to interconnect the movable plate 81 and the support plate 82. The above support plate 82 has a cutaway portion (recess) 82*a* formed in a center portion thereof, the cut-away portion being surrounded by the connecting rods 89.

Further, the drive power transmitting means, which transmits the drive power of the DC motor 85 to the support plate 82 and the movable plate 81, comprises a rotating wheel 86 mounted on a drive shaft 85*a* (see FIG. 5) of the DC motor 85 and having a drive protrusion 86*a* integrally formed on one side and at a predetermined distance from a center axis thereof, a driven shaft 83 one end of which is fixed to an upper portion of the support plate 82 and on another end of which is integrally formed a driven protrusion 83*a*, a power transmitting shaft 84 one end of which is rotatably connected to the drive protrusion 86*a* of the rotating wheel 86 and another end of which is rotatably connected to the driven protrusion 83*a* of the driven shaft 83 such that the shaft is driven to undergo rectilinear movement by the rotational movement of the rotating wheel 86 driven by the DC motor 85, and a fixed shaft 87 one end of which passes through the cut-away portion of the support plate 82 to be fixedly mounted to the side wall 62 of the cooking chamber 60 and on another end of which is formed a hinge member 87*a* to which a center portion of the power transmitting shaft 84 is hingedly fixed.

The power transmitting shaft 84 has a first hollow or slot 84*a* into which the drive protrusion 86*a* of the rotating wheel 86 is inserted, and a second hollow or slot 84*b* into which the driven protrusion 83*a* of the driven shaft 83 is inserted, the first and second hollows 84*a* and 84*b* being provided on opposite ends of the power transmitting shaft 84 corresponding to the positioning and size of the drive and driven protrusions 86*a* and 83*a*, respectively. Further, the first and second hollows 84*a* and 84*b* are formed at predetermined lengths along a longitudinal direction of the power transmitting shaft 84 starting from ends thereof and extending toward the hinge member 87*a*.

The operation of the microwave reflection varying device structured as in the above will be described hereinafter.

When food to be cooked has been placed in the cooking chamber 60 and a door of the microwave oven closed, if power is applied, the magnetron 72 radiates microwaves into the cooking chamber 60, thereby cooking or heating the food therein. Simultaneously with this operation, the DC motor 85 drives the rotating wheel 86 to rotate the same. Accordingly, the drive protrusion 86*a* rotates together with the rotating wheel 86 around the axis of the wheel to slide along the first hollow 84*a* of the power transmitting shaft 84 such that the shaft 84 undergoes a continuous oscillating motion on the hinge member 87*a* of the fixed shaft 87.

As a result, and due to the positioning of the driven protrusion 83*a* of the driven shaft 83 in the second hollow 84*b* of the power transmitting shaft 84, the driven shaft 83 undergoes rectilinear motion in the directions of the arrows in FIG. 4. Therefore, the support plate 82 also undergoes rectilinear motion as it is fixedly connected to the driven shaft 84. Through the interconnection of the support plate 82 with the movable plate 81 via the connecting rods 89, the movable plate 81 also undergoes rectilinear motion (inside the cooking chamber 60) concurrently with the support plate 82 and the driven shaft 83. Thus, microwaves already present in the cooking chamber will be reflected off the plate 81 at continuously varying angles.

Figure 6:
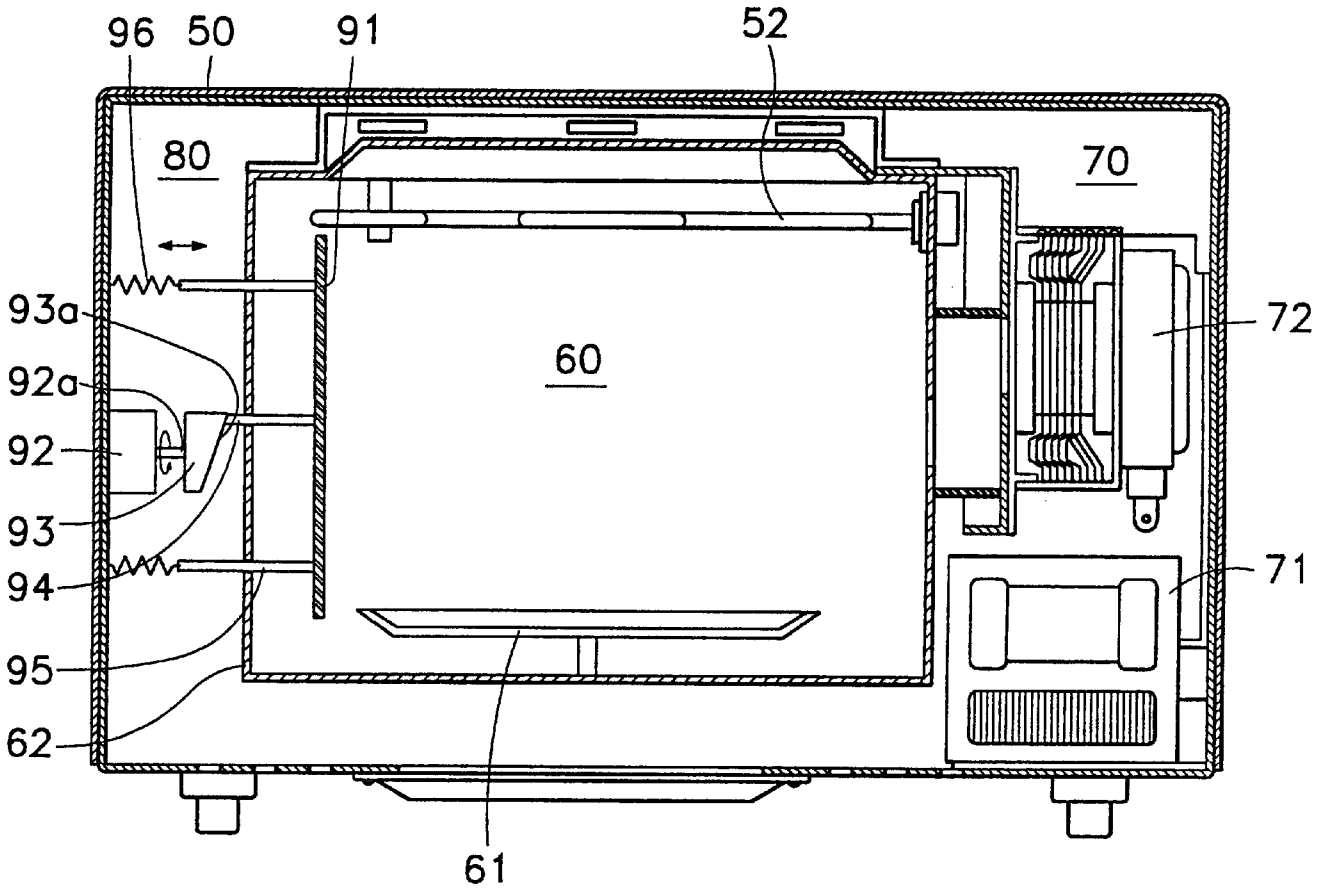
FIG. 6 is a front sectional view of a microwave oven according to a second preferred embodiment of the present invention.
Figure 7:
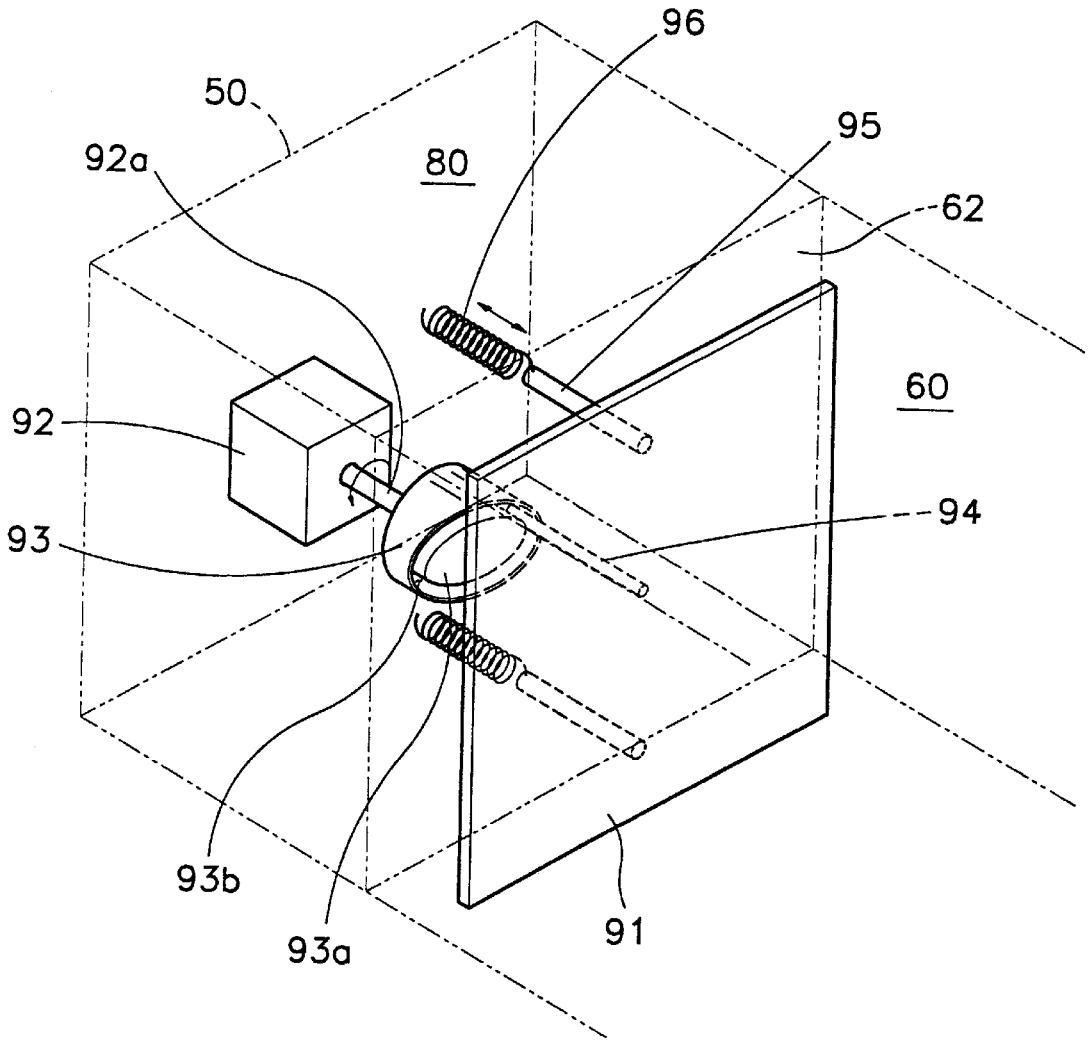
FIG. 7 is a perspective view of a microwave reflection varying device shown in FIG. 6.

Referring now to FIGS. 6 and 7, shown respectively are a front sectional view of a microwave oven according to a second preferred embodiment of the present invention, and a perspective view of a microwave reflection varying device shown in FIG. 6.

As the main elements of the microwave oven according to the second preferred embodiment are identical to those of the first embodiment, the same reference numerals will be used and an explanation thereof will be omitted.

As in the first embodiment, a microwave reflection varying device is provided in the second embodiment to vary the angles at which microwaves are reflected onto food placed in the cooking chamber 60 to more evenly cook or heat the food.

The microwave reflection varying device of the second embodiment is disposed partly in the cavity 80 and partly in the cooking chamber 60, and comprises drive means, angle-varying means for undergoing rectilinear movement at one side of the cooking chamber 60 by operation of the drive means, and drive power transmitting means for transmitting the drive power from the drive means to the angle-varying means.

The drive means comprises a DC motor 92 disposed inside the cavity 80 and mounted to an inside of a wall of the main body 50.

The angle-varying means comprises an element in the form of a quadrilateral plate 91 provided inside the cooking chamber 60 and which undergoes rectilinear movement in directions toward and away from the electrical component compartment 70 by power of the DC motor 92 transmitted from the drive power transmitting means, and a plurality of guide rods 95 connected to upper and lower portions of the movable plate 91 and extending into the cavity 80 after passing through the side wall 62 of the cooking chamber 60 to support the movable plate 91 and guide the rectilinear movement of the same.

The drive power transmitting means, which transmits the drive power of the DC motor 92 to the movable plate 91 of the angle-varying means, comprises a cylindrical cam 93 mounted to a drive shaft 92*a* of the DC motor 92 and a distal face 93*a* which is slanted obliquely with respect to the axis of the shaft 92*a*, a driven shaft 94 one end of which passes through the side wall 62 of the cooking chamber 60 to be connected to a center portion of the movable plate 91, and a plurality of springs 96 mounted to each guide rod 95 of the varying means and interposed between the guide rod 95 and the inside of the wall of the main body 50, the springs 96 providing pulling force to the variable plate 91 in a direction toward the side wall 62 of the cooking chamber 60.

As shown in FIG. 7, a groove 93*b* is formed at a predetermined depth around a circumference of the slanted distal face 93*a* of the cam 93. An end of the driven shaft 94 is inserted in the groove 93*b* of the cam 93 such that the cam 93 is operably connected to the movable plate 91. Since the movable plate 91 receives a return force in the direction of the side wall 62 of the cooking chamber 60 from the springs 96 (i.e., to the left in FIG. 6), the driven shaft 94 is prevented from slipping out of the groove 93*b* of the cam 93.

The operation of the second embodiment of the microwave reflection varying device structured as described above will be described hereinafter.

When food to be cooked has been placed in the cooking chamber 60 and the door of the microwave oven closed, if power is applied, the magnetron 72 radiates microwaves into the cooking chamber 60, thereby cooking or heating the food therein. At the same time, the DC motor 92 drives the cam 93 to rotate the cam. Accordingly, the driven shaft 94 inserted in the groove 93*b* of the cam 93 slides along the groove 93*b* such that the driven shaft 94 undergoes rectilinear motion. That is, because the groove 93*b* is formed on the slanted face 93*a* of the cam 93, the driven shaft 94 is forced in a direction pushing the plate 91 away from the side wall 62 of the cooking chamber 60 when the shaft 94 slides along a thick portion of the cam 93. Accordingly, the movable plate 91, connected to the driven shaft 94, undergoes rectilinear movement in direction toward and away from the side wall 62 of the cooking chamber 60, the movable plate 91 being pulled toward the side wall 62 by the springs 96 when the driven shaft 94 is sliding along a narrow portion of the cam 93. As the plate 91 moves, the angles by which the microwaves are reflected therefrom continuously change.

Referring now to FIG. 8, shown is a front sectional view of a microwave oven according to a third preferred embodiment of the present invention.

Here also, as the main elements of the microwave oven according to the third preferred embodiment is identical to that of the first embodiment, the same reference numerals will be used and an explanation thereof will be omitted.

As in the first embodiment, a microwave reflection varying device is provided in the third embodiment to vary the angles at which microwaves are reflected onto food placed in the cooking chamber 60 to more evenly cook or heat the food.

The microwave reflection varying device of the third embodiment is disposed partly in the cavity 80 and partly in the cooking chamber 60, and comprises drive means, angle-varying means for undergoing rectilinear movement on one side of the cooking chamber 60 by operation of the drive means to vary the reflection of microwaves onto food placed in the cooking chamber 60, and drive power transmitting means for transmitting the drive power supplied by the drive means to the angle-varying means.

The drive means comprises a linear motor 110 disposed inside the cavity 80 and mounted to an inside of a wall of the main body 50. The linear motor 110 is comprised of a first stator 111, a second stator 112, a permanent magnet 113 interposed between the first and second stators 111 and 112, and a coil 114.

The angle-varying means comprises an element in the form of a quadrilateral movable plate 101 provided inside the cooking chamber 60 and which undergoes rectilinear movement in directions toward and away from the electrical component compartment 70 by power of the linear motor 110 transmitted from the drive power transmitting means, and a plurality of guide rods 103 connected to upper and lower portions of the movable plate 101 and extending into the cavity 80 after passing through the side wall 62 of the cooking chamber 60 to support the movable plate 101 and guide the rectilinear movement of the plate 101.

The drive power transmitting means, which transmits the drive power of the linear motor 110 to the movable plate 101, comprises a drive element 115 disposed in a center portion of the linear motor 110 and which undergoes rectilinear movement therein by electromagnetic force of the linear motor 110, and a driven shaft 102 one end of which is connected to the drive element 115, passes through the side wall 62 of the cooking chamber, and another end of which is connected to a center portion of the movable plate 101.

The operation of the microwave reflection varying device structured as described above will be described hereinafter.

When food to be cooked has been placed in the cooking chamber 60 and the door of the microwave oven closed, if power is applied, the magnetron 72 radiates microwaves into the cooking chamber 60, thereby cooking or heating the food therein. At the same time, the linear motor 110 operates to drive the drive element 115 and the driven shaft 102 by electromagnetic force of the linear motor 110. Accordingly, the drive element 115 and the driven shaft 102 undergo rectilinear movement such that the movable plate 101, connected to the driven shaft 102, also undergoes rectilinear movement in the cooking chamber 60, thereby varying the reflection of microwaves present therein.

In the inventive microwave oven structured and operating as described above, as the microwaves are reflected in the cooking chamber at continuously varying angles during the operation of the microwave oven, the food is more evenly and effectively heated and cooked.

While the invention has been described in connection with what is presently considered to be most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A microwave oven comprising a main body; a cooking chamber provided in the main body; an electrical component compartment containing electrical components including a magnetron for supplying microwaves to the cooking chamber; and a microwave reflecting varying device for reflecting the microwaves present in the cooking chamber at varying angles during a cooking operation, wherein the microwave reflecting varying device comprises angle-varying means for undergoing rectilinear movement in the cooking chamber to reflect microwaves to varying angles, drive means, and drive power transmitting means for transmitting drive power from the drive means to the angle-varying means for producing the rectilinear movement, wherein the drive means comprises a DC motor mounted to an inside surface of a wall of the main body; and the varying means comprises a movable plate disposed inside the cooking chamber, and a plurality of guide rods connected to upper and lower portions of the movable plate and passing through a side wall of the cooking chamber to support the movable plate and guide a rectilinear movement of the movable plate.

2. The microwave oven of claim 1, wherein the drive power transmitting means comprises a cylindrical rotating wheel connected to the DC motor and having a drive protrusion integrally formed on one side, a driven shaft one end of which is fixed to an upper portion of the support plate and carrying a driven protrusion on another end thereof, a power transmitting shaft interconnecting the rotating wheel and the driven shaft to convert rotational movement of the DC motor into rectilinear movement of the driven shaft, and a fixed shaft one end of which is fixedly mounted to the side wall of the cooking chamber and another end of which is connected to a center portion of the power transmitting shaft.

3. The microwave oven of claim 2, wherein the power transmitting shaft has a first slot into which the drive protrusion of the rotating wheel is inserted, and a second slot into which the driven protrusion of the driven shaft is inserted.

4. The microwave oven of claim 1, wherein the drive power transmitting means comprises a cylindrical cam connected to the DC motor, a distal face of which is slanted obliquely relative to an axis of rotation of the cam, a driven shaft one end of which passes through the side wall of the cooking chamber and is connected to a center portion of the movable plate, and a plurality of springs mounted to each guide rod of the varying means and to the inside surface of the wall of the main body, the springs providing a pulling force to pull the movable plate in a direction toward the side wall of the cooking chamber.

5. The microwave oven of claim 4, wherein a groove is formed around a circumference of the slanted face of the cam, and the driven shaft being mounted in the groove.

6. A microwave oven comprising a main body; a cooking chamber provided in the main body; an electrical component compartment containing electrical components including a magnetron for supplying microwaves to the cooking chamber; and a microwave reflecting varying device disposed in the cooking chamber for reflecting the microwaves present in the cooking chamber at varying angles during a cooking operation, wherein the microwave reflecting varying device comprises angle-varying means for undergoing rectilinear movement in the cooking chamber to reflect microwaves to varying angles, drive means, and drive power transmitting means for transmitting drive power from the drive means to the angle-varying means for producing the rectilinear movement; wherein the drive means comprises a linear motor mounted to an inside surface of a wall of the main body; and the angle-varying means comprising a movable plate disposed inside the cooking chamber, and a plurality of guide rods connected to upper and lower portions of the movable plate and passing through a side wall of the cooking chamber to support the movable plate for rectilinear movement.

7. The microwave oven of claim 6, wherein the linear motor comprises a first stator, a second stator, a permanent magnet interposed between the first and second stators, and a coil.

8. The microwave oven of claim 7, wherein the drive power transmitting means comprises a drive element disposed in a center portion of the linear motor and which undergoes rectilinear movement therein by electromagnetic force of the linear motor, and a driven shaft one end of which is connected to the drive element and another end of which is connected to a center portion of the movable plate after passing through the side wall of the cooking chamber.

* * * * *